US007273409B2

(12) United States Patent
Hoffman

(10) Patent No.: US 7,273,409 B2
(45) Date of Patent: Sep. 25, 2007

(54) PROCESS FOR FORMING SPHERICAL COMPONENTS

(75) Inventor: Steve E. Hoffman, Englewood, NJ (US)

(73) Assignee: Mikronite Technologies Group, Inc., Daytona Beach, FL (US)

( * ) Notice: Subject to any disclaimer, the term of this patent is extended or adjusted under 35 U.S.C. 154(b) by 34 days.

(21) Appl. No.: 11/209,873

(22) Filed: Aug. 23, 2005

(65) Prior Publication Data

US 2006/0046620 A1 Mar. 2, 2006

Related U.S. Application Data

(60) Provisional application No. 60/604,555, filed on Aug. 26, 2004.

(51) Int. Cl.
*B24B 31/033* (2006.01)

(52) U.S. Cl. ..... 451/34; 451/57; 451/113

(58) Field of Classification Search ..... 451/37, 451/50, 104, 113, 34, 33, 32
See application file for complete search history.

(56) References Cited

U.S. PATENT DOCUMENTS

| | | | | |
|---|---|---|---|---|
| 1,512,350 | A | 10/1924 | McCorkle et al. | |
| 2,313,876 | A * | 3/1943 | Jelinek | 29/898.069 |
| 2,550,630 | A | 4/1951 | Whitehead | |
| 3,034,378 | A | 5/1962 | Anderson | |
| 3,107,706 | A | 10/1963 | Heinemann | |
| 3,233,372 | A | 2/1966 | Kobayashi | |
| 3,513,604 | A | 5/1970 | Matsunaga | |
| 4,073,095 | A | 2/1978 | Dreher | |
| 4,117,748 | A | 10/1978 | Watts | |
| 4,280,302 | A | 7/1981 | Ohno | |
| 4,580,371 | A | 4/1986 | Akhavi | |
| 4,586,292 | A | 5/1986 | Carroll et al. | |

(Continued)

FOREIGN PATENT DOCUMENTS

| | | | |
|---|---|---|---|
| AU | 232755 | * 10/1959 | 451/32 |

(Continued)

OTHER PUBLICATIONS

W.X. Zhang, C.Z. Ren, F. Zeng and X.M. Jin, "Shaping of Green Ceramic Balls and Precision Lapping for Ceramic Ball Bearings," *Advances in Grinding and Abrasive Processes*, www.ttp.net/0-87849-943-2/471.htm, 2 pages, (Dec. 28, 2003).

*Primary Examiner*—Robert A. Rose
(74) *Attorney, Agent, or Firm*—Drinker Biddle & Reath LLP

(57) ABSTRACT

A process is disclosed for forming a spherical component using a centrifugal processing machine. The process includes the steps of providing a component having an initial shape with at least a portion that is non-spherical, placing the component into a container in the centrifugal processor, adding a first stage abrasive media into the container, and rotating the container so as to produce centrifugal and rotational motion of the abrasive within the container. The motion of the abrasive causes the component shape to change from the initial shape to a substantially spherical shape through the repeated contacting of the component's surface by the abrasive. In one embodiment, the components are further processed in a second stage using a different media to polish the surface of the component.

16 Claims, 3 Drawing Sheets

U.S. PATENT DOCUMENTS

| | | | | | |
|---|---|---|---|---|---|
| 4,967,514 | A | | 11/1990 | Kunz | |
| 4,987,702 | A | * | 1/1991 | Anschutz | 451/328 |
| 5,012,619 | A | * | 5/1991 | Knepprath et al. | 451/326 |
| 5,140,783 | A | | 8/1992 | Hoffman | |
| 5,237,778 | A | * | 8/1993 | Baer | 451/326 |
| 5,355,638 | A | | 10/1994 | Hoffman | |
| 5,454,749 | A | | 10/1995 | Ohno | |
| 5,458,210 | A | | 10/1995 | Sollami | |
| 5,471,751 | A | | 12/1995 | Ball | |
| 5,477,616 | A | | 12/1995 | Williams et al. | |
| 5,486,135 | A | * | 1/1996 | Arpaio | 451/326 |
| 5,492,188 | A | | 2/1996 | Smith et al. | |
| 5,507,685 | A | * | 4/1996 | Hoffman | 451/34 |
| 5,555,788 | A | | 9/1996 | Gakhar et al. | |
| 5,802,932 | A | | 9/1998 | Vankov et al. | |
| 5,848,929 | A | | 12/1998 | Hoffman | |
| 5,873,770 | A | | 2/1999 | Hashimoto | |
| 5,896,800 | A | | 4/1999 | Curtsinger et al. | |
| 5,971,087 | A | | 10/1999 | Chaves | |
| 6,035,844 | A | | 3/2000 | Otani et al. | |
| 6,067,888 | A | | 5/2000 | Achterberg et al. | |
| 6,161,634 | A | | 12/2000 | Minikus et al. | |
| 6,196,341 | B1 | | 3/2001 | Chaves | |
| 6,220,375 | B1 | | 4/2001 | Butcher et al. | |
| 6,293,020 | B1 | | 9/2001 | Julien | |
| 6,511,559 | B2 | | 1/2003 | Brenner et al. | |
| 6,599,176 | B2 | | 7/2003 | Hoffman | |
| 6,708,594 | B1 | | 3/2004 | Iinuma | |
| 6,733,375 | B2 | | 5/2004 | Hoffman | |
| 6,745,472 | B2 | * | 6/2004 | Fujita et al. | 29/899 |
| 6,863,207 | B2 | | 3/2005 | Hoffman | |
| 6,863,600 | B2 | | 3/2005 | Friel, Sr. | |
| 6,875,081 | B2 | | 4/2005 | Hoffman | |
| 2002/0078813 | A1 | | 6/2002 | Hoffman | |
| 2003/0088979 | A1 | * | 5/2003 | Tomita | 29/888.02 |

FOREIGN PATENT DOCUMENTS

| | | | | |
|---|---|---|---|---|
| JP | 45-26358 | * | 8/1970 | 451/33 |
| JP | 46-10400 | * | 3/1971 | 451/32 |
| JP | 63-312809 | * | 12/1988 | 451/50 |
| JP | 3-117558 | * | 5/1991 | 451/50 |
| JP | 3-196963 | * | 8/1991 | 451/50 |
| WO | PCT/US03/021218 | | 7/2003 | |

* cited by examiner

PROCESS FOR FORMING SPHERICAL COMPONENTS

RELATED APPLICATION

This application is related to and claims priority from U.S. Provisional Application Ser. No. 60/604,555, filed Aug. 26, 2004, which is incorporated herein by reference in its entirety.

FIELD OF THE INVENTION

The present invention relates to a process for forming spherical components, such as ball bearings, and, more particularly, to the use of a high speed rotational processor to provide high precision spherical surfaces on a component.

BACKGROUND

Spherical balls are used in numerous mechanisms, such as roll cages and roller bearings, where a low friction interface is needed between two components, one moving relative to the other. In theory, the spherical shape means that there is only a single point of contact, thus allowing the ball to roll with a very minute amount of friction. In reality, it is virtually impossible to form a perfectly spherical ball. At some level the ball is not a perfect sphere and, thus, there is additional friction occurring.

In most uses for ball bearings, the relative speed between the two components is low enough such that the deviation from a perfect spheroid associated with a conventionally formed spherical balls does not produce sufficient friction to be of concern. In high speed assemblies, however, even a small eccentricity in the spherical shape can lead to increased friction and loading.

There are various processes currently available for forming spherical balls. The type of process used will depend on the material that the ball is made from. For example, most spherical ball bearings are formed from steel or a similar malleable material. Such material can be formed using many conventional molding or forming systems, such as by pouring the molten metal into a mold and cooling the metal (hot forming). Alternately the metal can be formed into a ball by cutting stock material to a suitable length and forging the material into a spherical shape with two dies (cold forming). Both of these processes result in a ring of material or flashing remaining where the dies meet (e.g., along the circumference). As such, these processes require a deflashing stage. Deflashing can be achieved by rolling the balls between two very heavy hardened steel or cast iron parallel plates called rill plates.

It is well known that materials tumbled with an abrasive will hone preferentially on peaked areas and eventually become blunt. Although this effect is widely observed, it rarely if ever yields a true glassy or polished surface as is necessary for modern precision industrial demands.

Because of the shortfalls of tumbling, the production of precision balls is almost exclusively performed using the rill plates. For metallic material balls, the balls are squeezed into shape between the plates. For composite material balls, the balls are ground with abrasives into a spherical shape, typically requiring up to 14 weeks of continuous processing. In this latter embodiment, the abrasive material eventually wears out the precision rill plates.

Also, since the above processes require the use of malleable or molten material to form the spherical shape, the resulting ball will lack sufficient hardness. Hence, the ball is typically subjected to a heat treat step to increase its hardness. Heat treatment typically occurs after the deflashing step.

After heat treatment, the ball is cleaned and then ground or filed to achieve the required sphericity and size. Finally, the ball is typically subjected to a lapping process and then polished. Further post forming steps may be required, such as passivation, where carryover iron and other contaminants are removed and a surface film is applied to prevent atmospheric and water corrosion on the balls.

In light of the foregoing, it should be readily apparent that the formation of a spherical metallic ball is quite complicated.

If it is desired to form the spherical ball from a hard, non-metallic material, such as ceramic material, the manufacturing process is even more complex. For example, in order to form ceramic spherical balls, ceramic material is first molded into an initial shape using two mold portions. As with the metallic molding process, the ceramic molding process typically results in a band or ring of material being formed about the periphery of the ball. In order to increase the sphericity of the ball, after the molding process, since ceramic material is not malleable, the ceramic balls must be sanded by hand to eliminate the rings. This process is very time consuming and costly.

A need exists for an improved process for forming spherical components from relatively hard materials.

SUMMARY OF THE INVENTION

A process is disclosed for forming a spherical component using a centrifugal processing machine. The process includes the steps of providing a component having an initial shape with at least a portion that is non-spherical, placing the component into a container in the centrifugal processor, adding a first stage abrasive media into the container, and rotating the container so as to produce centrifugal and rotational motion of the abrasive within the container. The motion of the abrasive causes the component shape to change from the initial shape to a substantially spherical shape through the repeated contacting of the component's surface by the abrasive.

In one embodiment, the components are further processed in a second stage using a different media to polish the surface of the component. The media in the second stage is preferably either aluminum oxide or diamond particles.

Preferably the container is filled to between about 30% and about 90% of its volume with abrasive and components. More preferably it is filled to greater than about 50% of its volume.

The first stage abrasive media is preferably a diamond abrasive powder having a size on average of between about 15 microns and about 30 microns.

In one embodiment, the spherical component being processed is made from a ceramic material.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION OF THE PREFERRED EMBODIMENTS

Figure 1:
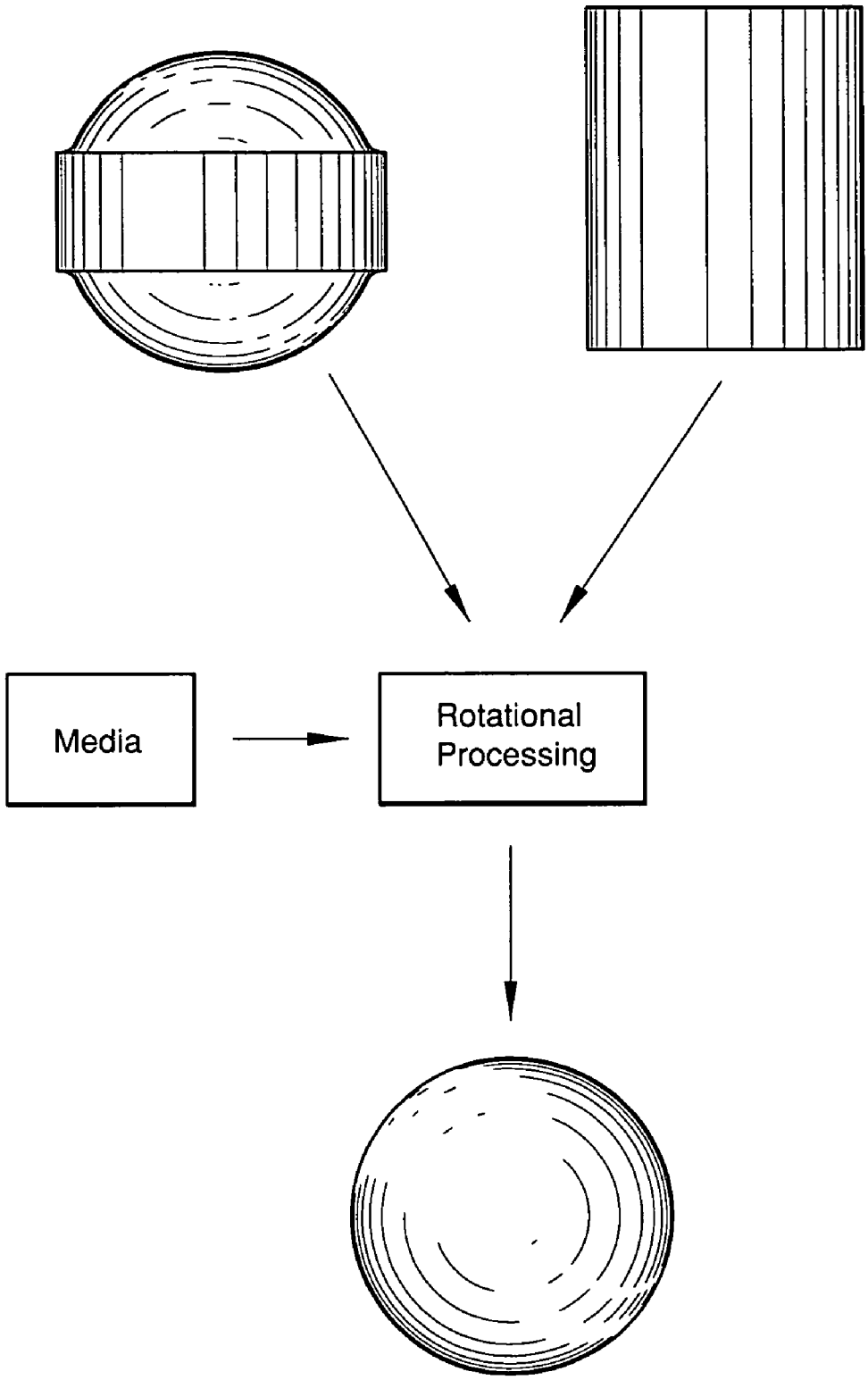
FIG. 1 is a general representation of the process for forming a spherical component according to the present invention.
Figure 2:
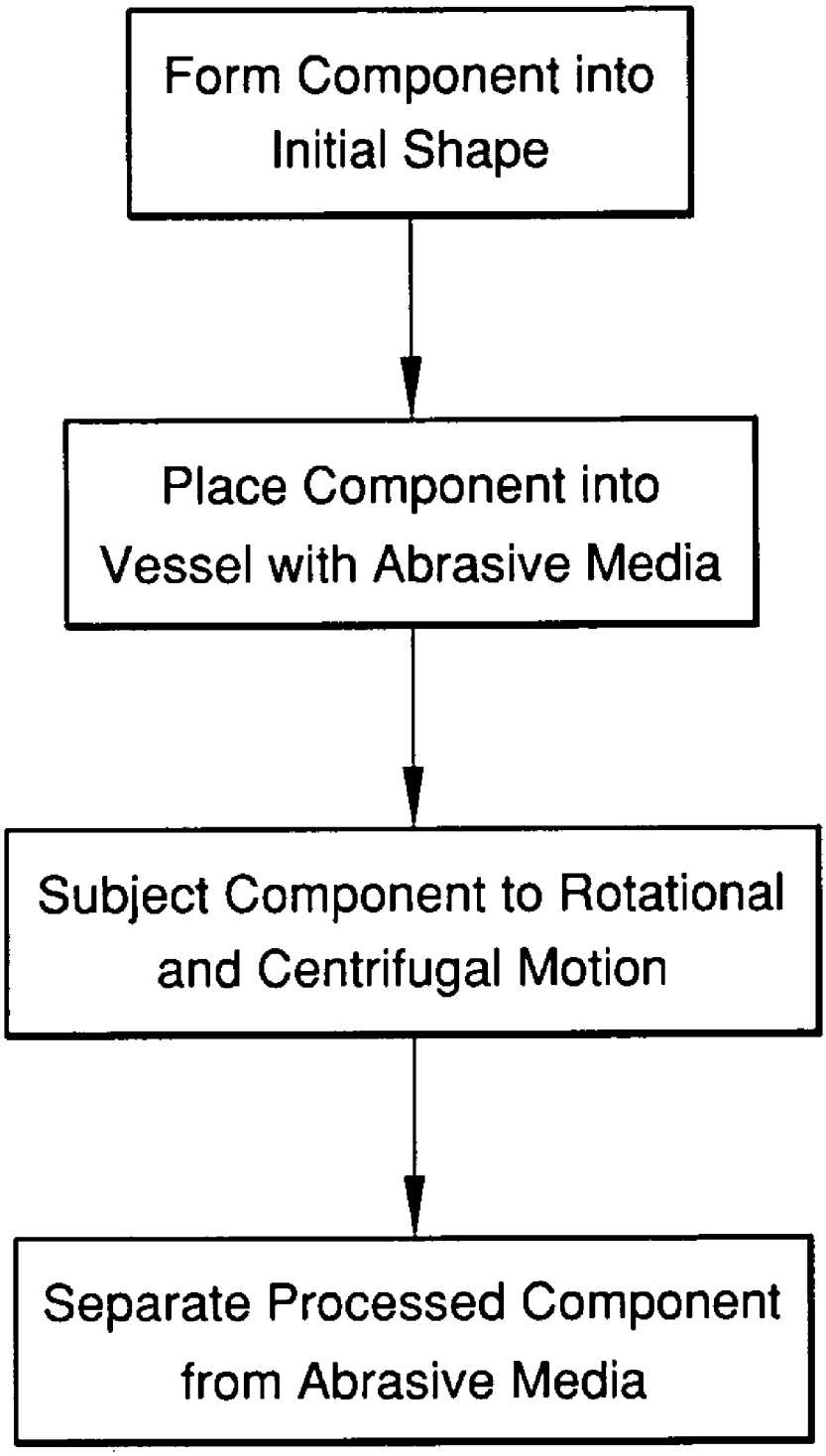
FIG. 2 is a flow chart illustrating one embodiment of the process according to the present invention.
Figure 3:
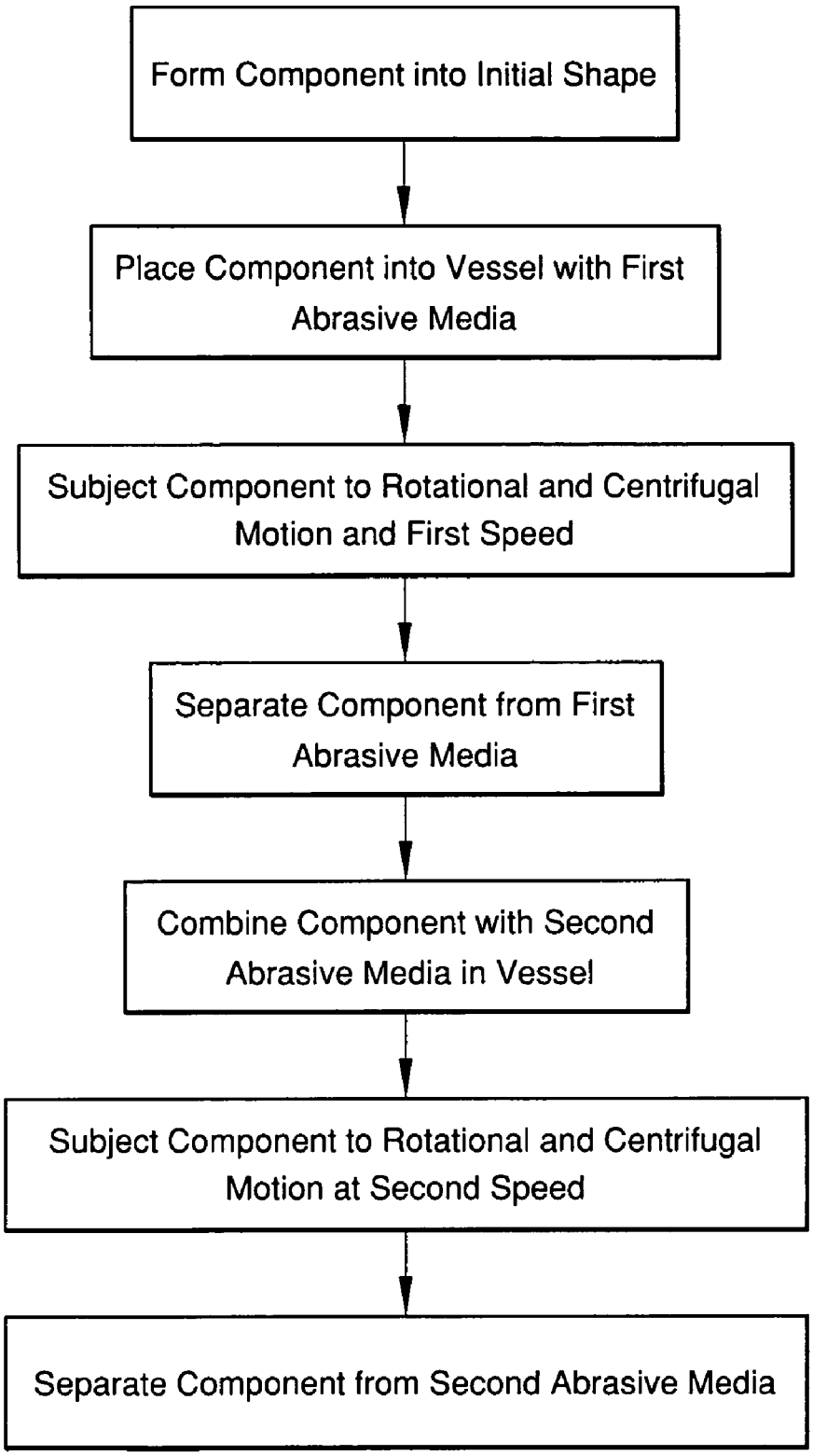
FIG. 3 is a flow chart illustrating a second embodiment of the process according to the present invention.

Referring now to the drawings, wherein like reference numerals refer to similar components throughout the views, an embodiment of the invention is shown for producing spherical processing of components. While the present invention is applicable to making spherical components from a variety of materials, it is particularly suited for use with relatively hard materials, such as ceramic and diamond.

The present invention replaces the for tooling for forming the spherical ball by controlling the slide of individual small particles in a highly energized state within a centrifugal barrel. The process suspends the parts being processed within a fluidized bed of abrasive material in the vessel. The abrasive material abrades off the irregular features of the quasi-spheres and ultimately polishes the parts.

The preferred process can be divided into two defined steps. The first is the shaping of the work piece and the second is the surface finishing. The shaping step forms the product into desired configuration. The surface finishing step forms a barrier inhibiting or reducing reactivity of the material with the environment. This results in longer life and increased strength.

In the first step or stage, the shaping step, the process involves larger material removal which is designed to shorten processing cycle time and overcome tooling errors of earlier fabrication techniques.

The process involves a first step of forming the material into a first state or shape. Preferably the shape is somewhat spherical, although it is also contemplated that the initial shape could simply be substantially cylindrical. The material can be formed into this initial shape using any conventional process known to those skilled in the art, such as forming or cutting bar stock.

One conventional method for forming a ceramic component involves mixing a powered raw material with a binding agent and then placing the mixture into a die and subjecting the mixture to an elevated pressure. Once the material is formed, it is then dried, typically through a heating process to remove the excess binder or other liquid. After drying, the material is subjected to a sintering process where the material is fired at elevated temperatures, typically 800 degrees C. to 2,000 degrees C. or more. The firing causes the individual crystals of the powder to sinter or bind together.

It is known that firing at higher temperatures produces more dense and less porous material. In addition to increased porosity at lower temperatures, lower temperatures also result in a rougher surface on the sintered product.

At this stage, the components formed in the conventional processes tend to have some degree of spherical or dimensional deviations/variances (e.g., eccentricities) and rough surfaces. Thus, the components are not suitable for use as high precision bearings or other rolling devices.

To form a high precision surface on the component, the component is subjected to abrasive processing in a rotational processing machine. One machine that is particularly suitable for such use is the Mikronite® VTD-8 processing machine, available from Mikronite Technologies, Inc., Carlstadt, N.J. U.S. patent application Ser. No. 10/326,674 and U.S. Pat. Nos. 5,355,638 and 5,848,929, which are incorporated herein by reference in their entirety, describe machines that are also suitable for providing the desired rotational processing. These machines are designed to subject components within a processing container to prolate cycloidic motion. This motion maximizes contact between the components and an abrasive media within the container. The motion also minimizes contact between the components and the walls of the container, thereby reducing damage to the components. The above machines are designed to achieve accelerations of upwards of 27 g's or more.

The components are placed into a container or vessel with an abrasive media mixture suitable for removing material from the component under high load.

In the first stage, it is preferable that the media used has a shape that is substantially or close to spherical itself. However it should be readily understood that media having any blunt shape can be used in this step of the process, including low quality metal or plastic balls. The media is selected to provide large areas of contact to be made during high energy processing. This high contact is further enhanced by the elastic deformation that occurs when the media selected is made from a malleable material. For example, a metal media ball with a hardness less than the hardness of the product being processed will deform on point to point contact with the product. This deformation results in different surface speeds across the entire contact area of the product, leaving a linear lapping scratch on the harder material.

While it is possible to process a plurality of products without media (i.e., allowing the products to contact one another during the processing stage), it is highly inefficient as compared to the use of a processing media. Preferably, the container/vessel is filled at least about ⅓ or greater by volume of softer media. The weight by volume of the media is preferably selected to approximate the weight by volume of the components being processed. The reason for this is that, under centrifuigal motion, different density materials tend to want to separate. As such, the centrifugal motion of a vessel in the present invention, in combination with the formation of a fluidized environment within the vessel, might otherwise result in the top to bottom migration of the heavier items (components or media) and an opposite flow of the lighter items. Testing of the present invention has shown that the migratory effect could become an issue if the there is a difference of 25% or more in weight by volume between the items (media vs. components). For example, migration may occur when using aluminum to process steel balls, with a weight of aluminum being ⅓ that of the steel balls by volume.

When using spherical balls as media for finishing larger spherical components, the size (diameter) of the media balls is preferably twice the size of the desired finishing stroke. For example, if the ball being finished is 2 inches in diameter, and the first stage includes removing material through the use of ⅛ inch strokes, the media balls should have a diameter of at least ¼ inch to produce the ⅛ inch strokes.

In processing metal spheres, one preferred abrasive for use in the first stage is silicon carbide powder, preferably 500 grit. In processing ceramics and sintered carbides, one preferred abrasive powder is diamond with a preferred size of approximately 15-30 micron.

The abrasive media is placed within a container such that between about 30% and 90% of the volume is filled. Preferably the volume is filled to between about 30% and 60%. More preferably it is filled to over 50% since that level of volume assists in keeping the product centered. The components (balls) being processed are preferably not fixtured or restrained within the container. Instead, the components are preferably free to move about the container (or at least a portion of the container) with the abrasive media.

Once the desired media and components are placed within the container, the container and, thus, the items within it are subjected to rotational and centrifugal motion. The operational parameters for the rotational processing would vary depending on several factors, including the material from which the component is made, the initial shape of the component, the type of machine being used, the type of abrasive media being used, the speed and/or g's that the components will be subjected to and the degree of finish desired. For example, ceramic components that start of with an initial shape that results from a molding operation can be process in the vessel described above at sufficient speed to a desired amount of impingement. The process can be run at between 25 g's and about 100 g's, for about 20 minutes through about 2 hours or more, depending on the material being processed. In one embodiment, the process was run at about 30 g's for about 30 minutes. This will result in abrasive removal of the excess material on the component, forming it into a spherical ball.

The rotational processing step produces an abrasive lapping of all sides of the component. This is particularly desirable when attempting to form a substantially uniform spherical component, such as a ball bearing. The high loading achievable using the machines discussed above permits relatively fast and inexpensive processing of ceramic and other hard materials.

After first processing stage is complete, the components are separated from the abrasive media. One method would be through a filtration process where the contents of the container are poured through a filter or sifter such that one of either the abrasive mixture or the components is inhibited from passing through. The abrasive media can then be reused provided the abrasive characteristics of the mixture are still sufficient to provide abrasive processing. If the components are made from a ferro-metallic material, a magnet can be used to assist in filtering the spherical components from the abrasive material.

At this point, the components are substantially spherical in shape. The second stage of the process is next performed to polish the components into precision spheres. Polishing is a far simpler process than the lapping process described above since, if properly handled, the media acts as a cushion against the component and, therefore, it is very difficult to over-polish the component. It has been determined that a preferred processing parameter for efficient polishing is to reverse the ratios such that the media accounts for at least approximately ⅔ of the total fill volume (i.e., media plus components).

In this second stage, the media includes a carrier and an abrasive material. The carrier may have a variety of shapes depending on its material composition. For example, the carrier may be jagged if made of a softer pulp or plastic product. In a preferred embodiment, the carrier is walnut shells ground and dried and screen sieved to yield a particle size less than ⅛ of an inch. This type of carrier quickly blunts its sharp edges and carries abrasive efficiently. The abrasive used is preferably harder than the material of the precision ball, and has a diameter (or maximum width dimension) no more then four times the depth of the largest tolerable scratch. For example if the desired scratches in the surface are to have a depth of ¼ micron, then an abrasive no larger than 1 micron should be used. Preferably the abrasives are aluminum oxide or diamond.

Since the media size is so small, it does not loft or separate to allow the precision balls to accumulate on top or bottom. As such, weight and volume are not as critical as in the first stage.

The parts are placed in the vessel (either the same or a different vessel), preferably toward the vessel center. The media may be added before or after the parts are added to the vessel. Due to the high volume of media with respect to the parts, the media generally keeps the parts separated from one another or results in very low velocity when the parts contact one another, thus reducing part-on-part damage. If two pieces cannot tolerate contact at all, for example if the parts might chemically react with one another, then a single part per vessel can be used, producing similar results.

Through the use of the present invention, it is possible to form ceramic spheres at lower sintering temperatures and then subsequently polish the spheres to form the final spherical product.

The present invention can also be used to form spheres from hard materials that have traditionally not been capable of being processed into spherical components, such as diamond. The high loads imposed by the processing machine, in combination with a high strength abrasive, such as aluminum oxide, silicon carbide, tungsten carbide and diamond, will cause abrasive polishing of the facets of the diamond until a spherical shape is achieved.

The present invention has particular applicability to products which require a smooth spherical shape. It can be run on all materials, including plastic and diamonds. The media and abrasive is selected depending on the material being processed. The abrasive is preferably selected such that it does not crack the surface of the product being processed. As shown in the figures, it is contemplated that the present invention may be performed as a single step or stage.

The present invention may be embodied in other specific forms without departing from the spirit or essential attributes thereof and, accordingly, reference should be made to the appended claims, rather than to the foregoing specification, as indicating the scope of the invention.

What is claimed is:

1. A process for forming a spherical component comprising the steps of:

providing a plurality of ceramic components each having an initial shape with a spherical portion and non-spherical portion;

providing a centrifugal processor with at least one processing container;

placing the components into the container;

adding a first stage abrasive media into the container;

rotating the container at a first speed so as to produce centrifugal and rotational motion of the first stage abrasive media within the container;

causing each component's shape to change from its initial shape, including the non-spherical portion, to a substantially spherical shape through the repeated contacting of the component's surface by the first stage abrasive media;

changing the media from the first stage media to a second stage media;

rotating the container at a second speed so as to produce centrifugal and rotational motion of the second stage media within the container;

causing repeated contacting of the component's surface by the second stage media so as to produce polishing of the component's surface by the second stage media; and removing the processed spherical component from the container;

wherein the first stage media is substantially spherical in shape.

2. A process for forming a spherical component according to claim 1 wherein the size of the first stage media is selected to have a diameter that is twice the size of a desired processing stroke on the component.

3. A process for forming a spherical component comprising the steps of:

providing a plurality of ceramic components each having an initial shape with a spherical portion and non-spherical portion;

providing a centrifugal processor with at least one processing container;

placing the components into the container;

adding a first stage abrasive media into the container;

rotating the container at a first speed so as to produce centrifugal and rotational motion of the first stage abrasive media within the container;

causing each component's shape to change from its initial shape, including the non-spherical portion, to a substantially spherical shape through the repeated contacting of the component's surface by the first stage abrasive media;

changing the media from the first stage media to a second stage media;

rotating the container at a second speed so as to produce centrifugal and rotational motion of the second stage media within the container;

causing repeated contacting of the component's surface by the second stage media so as to produce polishing of the component's surface by the second stage media; and removing the processed spherical component from the container;

wherein the first stage media is made from a malleable material.

4. A process for forming a spherical component according to claim 3 wherein the first stage media comprises metallic balls with a hardness that is less than the hardness of the component being processed.

5. A process for forming a spherical component comprising the steps of:

providing a plurality of ceramic components each having an initial shape with a spherical portion and non-spherical portion;

providing a centrifugal processor with at least one processing container;

placing the components into the container;

adding a first stage abrasive media into the container;

rotating the container at a first speed so as to produce centrifugal and rotational motion of the first stage abrasive media within the container;

causing each component's shape to change from its initial shape, including the non-spherical portion, to a substantially spherical shape through the repeated contacting of the component's surface by the first stage abrasive media;

changing the media from the first stage media to a second stage media;

rotating the container at a second speed so as to produce centrifugal and rotational motion of the second stage media within the container;

causing repeated contacting of the component's surface by the second stage media so as to produce polishing of the component's surface by the second stage media; and removing the processed spherical component from the container;

wherein the weight by volume of the first stage media is approximately the same as the weight by volume of the components being processed.

6. A process for forming a spherical component comprising the steps of:

providing a plurality of ceramic components each having an initial shape with a spherical portion and non-spherical portion;

providing a centrifugal processor with at least one processing container;

placing the components into the container;

adding a first stage abrasive media into the container;

rotating the container at a first speed so as to produce centrifugal and rotational motion of the first stage abrasive media within the container;

causing each component's shape to change from its initial shape, including the non-spherical portion, to a substantially spherical shape through the repeated contacting of the component's surface by the first stage abrasive media;

changing the media from the first stage media to a second stage media;

rotating the container at a second speed so as to produce centrifugal and rotational motion of the second stage media within the container;

causing repeated contacting of the component's surface by the second stage media so as to produce polishing of the component's surface by the second stage media; and removing the processed spherical component from the container;

wherein the first stage media accounts for at least ⅓ of the total volume of the combination of the first stage media and components in the container.

7. A process for forming a spherical component according to claim 6 wherein the second stage media accounts for at least ⅔ of the total volume of the combination of second stage media and components in the container.

8. A process for forming a spherical component comprising the steps of:

providing a plurality of ceramic components each having an initial shape with a spherical portion and non-spherical portion;

providing a centrifugal processor with at least one processing container;

placing the components into the container;

adding a first stage abrasive media into the container;

rotating the container at a first speed so as to produce centrifugal and rotational motion of the first stage abrasive media within the container;

causing each component's shape to change from its initial shape, including the non-spherical portion, to a substantially spherical shape through the repeated contacting of the component's surface by the first stage abrasive media;

changing the media from the first stage media to a second stage media;

rotating the container at a second speed so as to produce centrifugal and rotational motion of the second stage media within the container;

causing repeated contacting of the component's surface by the second stage media so as to produce polishing of the component's surface by the second stage media; and removing the processed spherical component from the container;

wherein the abrasive in the second stage media has a maximum width dimension that is no more than approximately four times the depth of a maximum tolerable scratch permitted on the component after processing is complete.

9. A process for forming a spherical component comprising the steps of:

providing at least one component having an initial shape with at least a portion that is non-spherical;

providing at least one container;

placing the component into the container;

adding a first processing media into the container for processing the surface of the component, wherein between about 30% and about 90% of the volume of the container is filled with the first media and components;

placing the container in a centrifugal processor;

rotating the container so as to produce centrifugal and rotational motion of the first processing media within the container;

causing the component shape to change from the initial shape, including the non-spherical portion, to a substantially spherical shape through the repeated contacting of the component's surface by the first processing media;

separating the component from the first processing media after the shape of the component has changed;

adding a second finishing media to the container, the second finishing media being different than the first processing media;

rotating the container so as to produce centrifugal and rotational motion of the second finishing media within the container so as to cause the second finishing media to polish the surface of the component; and removing the substantially spherical component from the abrasive;

wherein the first processing media is substantially spherical in shape.

10. A process for forming a spherical component according to claim 9 wherein the size of the first processing media is selected to have a diameter that is twice the size of a desired processing stroke on the component.

11. A process for forming a spherical component comprising the steps of:

providing at least one component having an initial shape with at least a portion that is non-spherical;

providing at least one container;

placing the component into the container;

adding a first processing media into the container for processing the surface of the component, wherein between about 30% and about 90% of the volume of the container is filled with the first media and components;

placing the container in a centrifugal processor;

rotating the container so as to produce centrifugal and rotational motion of the first processing media within the container;

causing the component shape to change from the initial shape, including the non-spherical portion, to a substantially spherical shape through the repeated contacting of the component's surface by the first processing media;

separating the component from the first processing media after the shape of the component has changed;

adding a second finishing media to the container, the second finishing media being different than the first processing media;

rotating the container so as to produce centrifugal and rotational motion of the second finishing media within the container so as to cause the second finishing media to polish the surface of the component; and removing the substantially spherical component from the abrasive;

wherein the first processing media is made from a malleable material.

12. A process for forming a spherical component according to claim 11 wherein the first processing media comprises metallic balls with a hardness that is less than the hardness of the component being processed.

13. A process for forming a spherical component comprising the steps of:

providing at least one component having an initial shape with at least a portion that is non-spherical;

providing at least one container;

placing the component into the container;

adding a first processing media into the container for processing the surface of the component, wherein between about 30% and about 90% of the volume of the container is filled with the first media and components;

placing the container in a centrifugal processor;

rotating the container so as to produce centrifugal and rotational motion of the first processing media within the container;

causing the component shape to change from the initial shape, including the non-spherical portion, to a substantially spherical shape through the repeated contacting of the component's surface by the first processing media;

separating the component from the first processing media after the shape of the component has changed;

adding a second finishing media to the container, the second finishing media being different than the first processing media;

rotating the container so as to produce centrifugal and rotational motion of the second finishing media within the container so as to cause the second finishing media to polish the surface of the component; and removing the substantially spherical component from the abrasive;

wherein the weight by volume of the first processing media is approximately the same as the weight by volume of the components being processed.

14. A process for forming a spherical component comprising the steps of:

providing at least one component having an initial shape with at least a portion that is non-spherical;

providing at least one container;

placing the component into the container;

adding a first processing media into the container for processing the surface of the component, wherein between about 30% and about 90% of the volume of the container is filled with the first media and components;

placing the container in a centrifugal processor;

rotating the container so as to produce centrifugal and rotational motion of the first processing media within the container;

causing the component shape to change from the initial shape, including the non-spherical portion, to a substantially spherical shape through the repeated contacting of the component's surface by the first processing media;

separating the component from the first processing media after the shape of the component has changed;

adding a second finishing media to the container, the second finishing media being different than the first processing media;

rotating the container so as to produce centrifugal and rotational motion of the second finishing media within the container so as to cause the second finishing media to polish the surface of the component; and removing the substantially spherical component from the abrasive;

wherein the first processing media accounts for at least ⅓ of the total volume of the combination of the first processing media and components in the container.

15. A process for forming a spherical component according to claim 14 wherein the second finishing media accounts for at least ⅔ of the total volume of the combination of second finishing media and components in the container.

16. A process for forming a spherical component comprising the steps of:

providing at least one component having an initial shape with at least a portion that is non-spherical;

providing at least one container;

placing the component into the container;

adding a first processing media into the container for processing the surface of the component, wherein between about 30% and about 90% of the volume of the container is filled with the first media and components;

placing the container in a centrifugal processor;

rotating the container so as to produce centrifugal and rotational motion of the first processing media within the container;

causing the component shape to change from the initial shape, including the non-spherical portion, to a substantially spherical shape through the repeated contacting of the component's surface by the first processing media;

separating the component from the first processing media after the shape of the component has changed;

adding a second finishing media to the container, the second finishing media being different than the first processing media;

rotating the container so as to produce centrifugal and rotational motion of the second finishing media within the container so as to cause the second finishing media to polish the surface of the component; and removing the substantially spherical component from the abrasive;

wherein the abrasive in the second finishing media has a maximum width dimension that is no more than approximately four times the depth of a maximum tolerable scratch permitted on the component after processing is complete.

* * * * *